United States Patent [19]

Welty

[11] 4,163,442

[45] Aug. 7, 1979

[54] FIREPLACE HEAT SYSTEM

[76] Inventor: Robert O. Welty, 7841 Eastwood Dr., Minneapolis, Minn. 55432

[21] Appl. No.: 842,745

[22] Filed: Oct. 17, 1977

[51] Int. Cl.[2] ..... F24B 7/00

[52] U.S. Cl. ..... 126/121; 126/120; 126/164

[58] Field of Search ..... 126/121, 164, 120, 135, 126/126, 136, 140, 63, 288, 152 R, 164, 153, 201, 298, 165

[56] References Cited

U.S. PATENT DOCUMENTS

| | | | |
|---|---|---|---|
| 236,370 | 1/1881 | Smith | 126/121 |
| 1,608,745 | 11/1926 | Holbek | 126/121 |
| 1,747,259 | 2/1930 | Pierce | 126/121 |
| 2,161,723 | 6/1939 | Rutland | 126/121 |
| 3,880,141 | 4/1975 | Abshear | 126/121 |
| 3,901,212 | 8/1975 | Stites | 126/121 |
| 3,955,553 | 5/1976 | Soeffker | 126/121 |
| 4,088,114 | 5/1978 | Johnson | 126/121 X |

*Primary Examiner*—Dennis L. Taylor
*Attorney, Agent, or Firm*—Hugh D. Jaeger

[57] ABSTRACT

A fireplace heat system to maximize heat transfer from a fireplace to the surrounding environment of the immediate area outside the fireplace to reduce the heat loss of the fire rising up the fireplace flue and chimney. Maximum heat transfer of the fire in the fireplace is obtained by utilization of thermodynamically short pipes, production of turbulence in the pipes, and pipe length to diameter ratio of less than fifty. The fireplace heat system consists of equal lengths of standard black iron malleable pipe forming U-shaped structures having legs on one side connected together to form U-shaped apparatus. The legs on the connected side of the U-shaped apparatus are positioned above and parallel to the fireplace floor. A forced air blower forces air through an air input manifold which connects the legs of the U-shaped structures. Air is forced through the pipes of the U-shaped apparatus and exits at the top of the opposing set of legs into the surrounding environment of the immediate area of the fireplace. The end pipes of the U-shaped apparatus opposite the end of forced air blower are partially closed to restrict, balance and equalize the air flow through all of the pipes. The components of the fireplace heat system are easily replaceable in the unlikely event of burn through of any of the pipes.

8 Claims, 3 Drawing Figures

FIREPLACE HEAT SYSTEM

BACKGROUND OF THE INVENTION

1. Field of the Invention

The present invention relates generally to improvements in fireplaces, and more particularly pertains to a new and improved fireplace heat system wherein maximum heat transfer is obtained from the fire in the fireplace to the surrounding environment.

2. Description of the Prior Art

Those concerned with the development of fireplaces have long recognized the need for a fireplace heat system having maximum heat transfer from the fire in the fireplace to the surrounding environment such as a room in a home. Prior art fireplace systems, also known in the art as auxilliary heaters, heat distribution units, forced air heaters, heaters, furnaces, hollow grates, heat extractors, etc., have all failed to maximize the heat transfer from the fire in the fireplace to the surrounding environment adjacent to the fireplace such as a room in a home. In an attempt to maximize heat transfer, prior art systems were either built into the fireplace and chimney or were removable units which could be placed into the fireplace. Some of these types of prior art heat exchangers would utilize forced air through the various mazes of interconnected pipes to further attempt to maximize the heat transfer from the fire in the fireplace to the surrounding environment. These types of devices fail to realistically maximize and recover the heat in the fire of the fireplace which normally rises up through the fireplace chimney into the outside environment.

The prior art fireplace systems which are installed in existing fireplaces are constructed in such a manner that the lower tubes or pipes which act as a grate in supporting the fire are subject to burn through and are not individually replaceable. In the event of burn through, it is necessary to replace the entire fireplace system. The middle of the fire on the grate reaches extremely high temperatures resulting in burn through of individual or a plurality of tubes or pipes resulting in a fireplace system which is no longer useable as the uncombusted gases of the fire and smoke are forced through the burn through area by either the conductive air forces or the forced air.

Other prior art fireplace systems are extremely cumbersome super structures not easily insertable into the fire box of the fireplace. These fireplace systems are also difficult to ship to a home owner let along being a suitable size for installation in fireplaces having various dimensions fireplace to fireplace.

These prior art fireplace systems utilize air convective principles to circulate air through the system thereby inefficiently extracting heat from the fire of the fireplace. Also, the various sizes of the tubes or pipes constrict the flow of air through the structure to transfer heat from the fire of the fireplace to the environment adjacent to the fireplace. The structures are not only inefficient heat exchanges having an extremely low heat transfer but also have an extremely short usefullness on account of the intense heat occuring at the bottom tube or pipe members resulting in burn through of the pipes which may finally permit the air passing through the pipes to pick up sparks and products of combustion and discharge these into the adjacent environment resulting in a fire hazard.

Conventional fireplaces generally found in residences are extremely inefficient as a source of transferring heat from the fireplace into the surrounding room environment as a large percentage of the heat from the fire in the fireplace rises up and out of the flue and chimney of the fireplace. As a consequence, fireplaces provided in residences have been more for appearance and decorative utilization, and have not been relied upon to heat entire residences. Primary heating systems such as gas or oil heaters are generally utilized for heating residences and fireplaces supplement these heating systems for an evening or afternoon effect.

While prior art structures have been provided in the fireplace to increase the heat transfer by heating air passing through or being forced through the structures, these devices in the past have been generally extremely inefficient and further detract from the ornamental appearance of the fireplace. These structures are apt to be positioned in the fireplace along with the grate or if the structure acts as a combined grate, then has to physically fit the dimensions of the residences' fireplace.

This invention overcomes the disadvantages of the prior art by providing a fireplace heat system which maximizes heat transfer from the fireplace to the outside room environment.

SUMMARY OF THE PRESENT INVENTION

The present invention obviates the foregoing disadvantages of the prior art by providing a fireplace heat system which maximizes heat transfer between the fireplace and the surrounding environment. The heat transfer is maximized by producing turbulence within the fireplace heat system resulting in an extremely large heat transfer coefficient. The forced air flow through the fireplace heat system results in a turbulent flow resulting in heat transfer greater than that of air with a laminar flow through such a system. The fireplace heat system is also constructed of replaceable black iron heavy wall malleable pipe resulting in long life, durability, and safety while in operation.

According to an embodiment of the present invention, there is provided a fireplace heat system having a U-shaped apparatus consisting of a plurality of U-shaped structures having two legs and a connecting member together on one side of the U-shaped structures, the plurality of legs on one side of the U-shaped structures being positioned parallel to the base of the fireplace, the plurality of the connecting members of the U-shaped members being positioned to the back of the fireplace, and the opposing legs of the U-shaped structures being restricted to balance the air flow throughout the U-shaped apparatus and an forced air blower coupled to the connected U-shaped structures whereby the forced air blower forces air from the adjacent environment through the U-shaped apparatus resulting in maximized heat transfer of the fire in the fireplace to the air being forced through the U-shaped apparatus to heat the surrounding environment adjacent to the fireplace.

A significant aspect and feature of the present invention is a fireplace heat system which has a high heat transfer coefficient resulting from turbulent flow of the air within the structure of the fireplace heat system. The turbulent flow caused by turbulence producing physical structure of the fireplace heat system results in maximization of heat transfer from the fire in the fireplace to the air being forced through the structure by a forced air blower.

Another significant aspect and feature of the present invention is the simplicity and reliability of the fireplace heat system of the present invention residing in the fact that the system is easy to ship in transit and assemble by the user not requiring complicated tools, nothing more than the ordinary pipe wrench or adjustable pliers. Also, the fireplace heat system permits the replacement of any components in the unlikely event that a burn-out in one of the pipes occurs.

An advantageous feature of the invention resides in the fact that the specific physical structure due to the internal roughness of the pipes, rough edges of the pipes at the elbows, the forcing of air around right angles, the length to diameter ratio of the pipes being less than fifty, thermodynamically short pipes, and no opportunity for damping, all cooperate solely and jointly to produce turbulence resulting in maximization of the heat transfer in the fireplace heat system.

Having briefly described one embodiment of the present invention, it is a principal object thereof to provide a new and improved fireplace heat system for transferring heat from the fire in the fireplace to the environment of the immediate area outside the fireplace.

It is an object of the present invention to provide a fireplace heat system which utilizes readily commercial available components to permit ease of shipment to a user and to permit easy assembly on location. In the unlikely event that a burn-out would occur of one of the components such as horizontal pipes which act as a fireplace grate, the user can readily obtain a replaceable component from the local hardware or plumbing store.

A further object of the present invention is to provide a fireplace heat system to maximize heat transfer from the fire on the horizontal pipes which acts as a fireplace grate to the environment of the immediate area outside the fireplace. By maximizing heat transfer from the fire to the air flowing through the fireplace heat system structure, less heat is lost up the flue and the chimney of the fireplace. In today's world of energy shortage, this is particularly beneficial to an user.

Still another object of the present invention is to provide a fireplace heat system structure of design which produces turbulent flow of air through the structure to maximize heat transfer which is greater than heat transfer with laminar air flow of the prior art devices. The heat transfer coefficient with turbulent flow is in the range of nineteen and greater. The turbulence is produced by the rough edges of the black iron malleable pipe which is commonly used in the plumbing industry and is also known as black pipe, forcing the air around right angles where pipes connect to form the U-shaped structures, a length to diameter ratio of the pipe of fifty or less resulting in thermodynamically short pipes, and of such a design as not permitting the opportunity for damping to occur in the structure.

A still additional object of the present invention is to provide a fireplace heat system using caps evenly so that maximum air flow occurs in the middle pipes with the air flow decreasing towards the end pipes. This is accomplished by selectively restricting the air flow in the end pipes with respect to the beginning pipes nearest the forced air blower. By balancing the air flow accordingly, it is possible to obtain maximum heat transfer, especially when the hottest portion of the fire is usually in the center of the fireplace heat system.

A further additional object of the present invention is to provide a forced air blower which attaches to the air input manifold consisting of the bottom plurality of horizontal pipes connected together which connects to a hose to force air through the fireplace heat system. The use of a hose permits placement of the forced air blower anywhere in the immediate area of the fireplace.

BRIEF DESCRIPTION OF THE DRAWINGS

Other objects and many of attendant advantages of this invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENT

Figure 1:
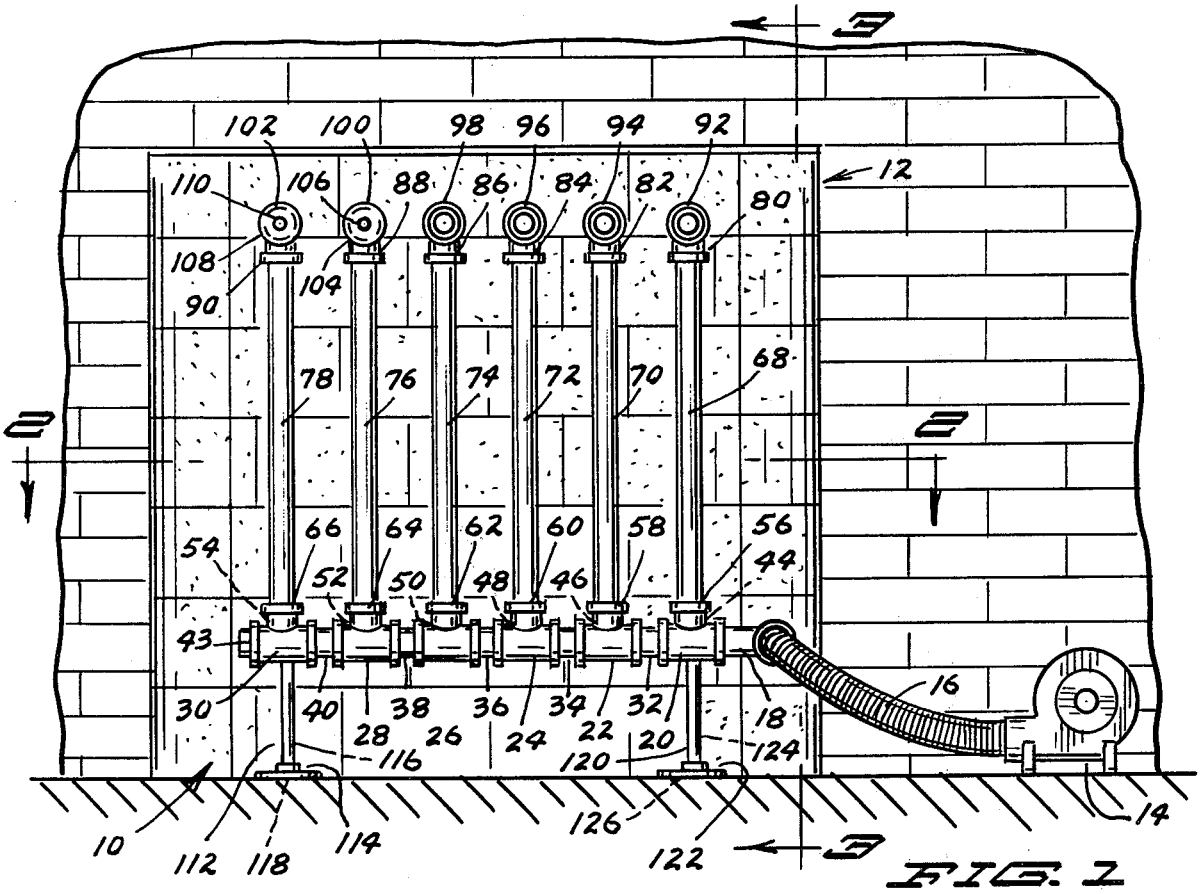
FIG. 1 illustrates a front view of a preferred embodiment of a fireplace heat system, the invention.

FIG. 1 illustrates a front view of a preferred embodiment of a fireplace heat system 10, the invention, centrally positioned in a fireplace 12. A forced air blower 14 such as a squirrel cage fan for way of example and purposes of illustration only connects to a ninety degree street elbow 18 of the fireplace heat system 10 through a hose 16 such as flexible metal exhaust pipe or plastic tubing for way of example and purposes of illustration only. An alternating series of tees 20–30 and close nipples 32–40 connect to the street elbow 18 forming an air input manifold 42. The number of tees is one greater than the number of nipples for purposes of operation. A pipe plug 43 closes an exterior side of the final tee 30. A plurality of equally threaded horizontal lengths of pipe 44–54, legs of U-shaped structures, shown in FIG. 2 traverse from the leg of each of the tees 20–30 horizontally towards the rear of the fireplace and the specific member of pipes illustrated is not to be construed as limiting of the invention. A plurality of equally threaded vertical lengths of pipe 68–78, connecting members for the U-shaped structure, connect to the plurality of equally threaded horizontal lengths of pipe 44–54 shown in FIG. 2 through ninety degree pipe elbows 56–66 shown in FIGS. 1 and 2. A plurality of equally threaded horizontal lengths of pipe 92–102, opposing legs of U-shaped structures, connect to the plurality of equally threaded vertical lengths of pipe 68–78 through ninety degree pipe elbows 80–90. Pipe caps 104 and 108 with holes 106 and 110 screw onto the ends of the equally threaded horizontal lengths of pipe 100 and 102 to restrict the air flow exiting from these pipes opposite to the point of introduction of the forced air to balance the air flow as is later described. Pipe legs 112, 116 (not illustrated), 120 and 124 illustrated in FIG. 3 weld on to the underside of the pipe tee 30, the pipe elbow 66, the pipe tee 20, and the pipe elbow 58 respectively. Floor flanges 114, 118 (not illustrated), 122, and 126 illustrated in FIG. 3 attach to the pipe legs 112, 116, 120 and 124 respectively.

Figure 2:
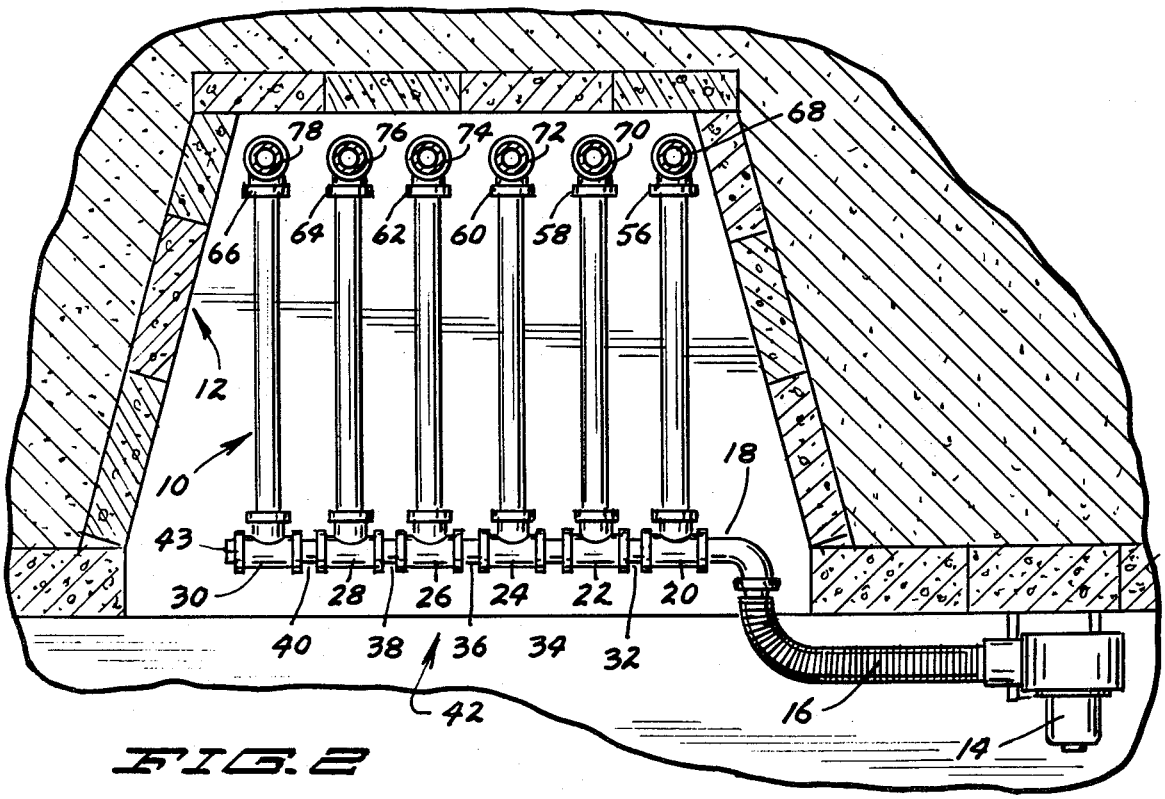
FIG. 2 illustrates a section of the invention taken on the line 2—2 of FIG. 1 looking in the direction of the arrows.

FIG. 2 illustrates a section of the fireplace heat system 10 in the fireplace 12 taken on the line 2—2 of FIG. 1 looking in the direction of the arrows illustrating the forced air blower 14, the hose 16, the street elbow 18, the alternating series of pipe tees 20–30 and close nipples 32–40 forming the air input manifold 42, the pipe plug 43, the plurality of equally threaded horizontal lengths of pipe 44–54, the right angle pipe elbows 56–66, and the plurality of equally threaded vertical lengths of pipe 68–78 which connect in the arrangement as previously described.

Figure 3:
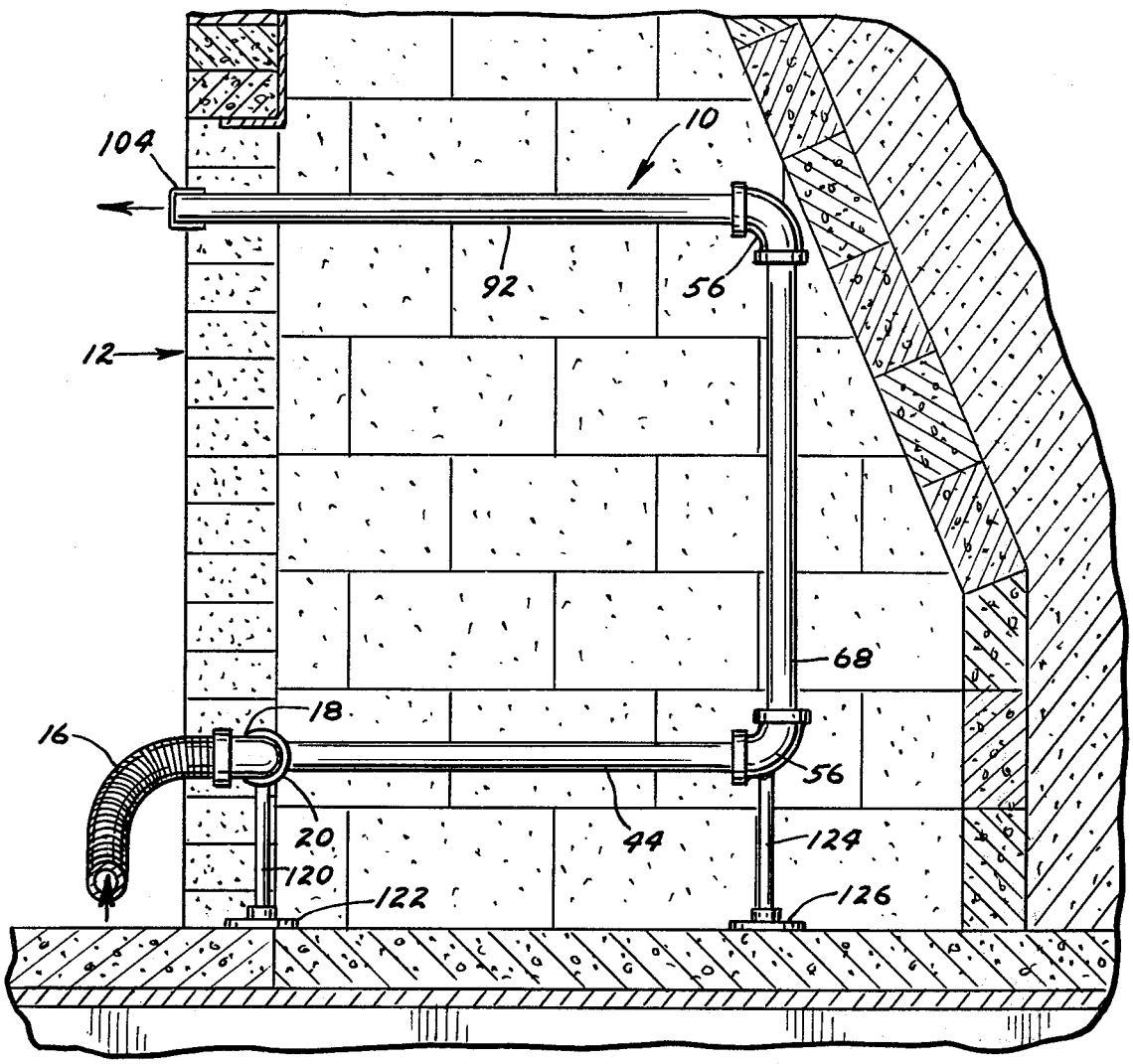
FIG. 3 illustrates a section of the invention taken on the line 3—3 of FIG. 1 looking in the direction of the arrows.

FIG. 3 illustrates a section of the fireplace heat system 10 in the fireplace 12 taken on line 3—3 of FIG. 1 looking in the direction of the arrows illustrating the hose 16, the ninety degree street elbow 18 connecting to the tee 20, the threaded horizontal length of pipe 44, the ninety degree angle elbow 56, the threaded vertical length of pipe 68, the ninety degree elbow 56, the threaded horizontal length of pipe 92, and the pipe cap 104 having hole 106 screwed onto the end of the threaded horizontal length of pipe 100 which connect in the arrangement as previously described. The pipe legs 120 and 124 with the flanges 122 and 126 respectively weld onto the underside of the pipe tee 20 and the ninety degree pipe elbow 56.

PREFERRED MODE OF OPERATION

The fireplace heat system 10 is centrally positioned in a fireplace 12 so that the four flanges 114, 118, 122 and 126 securely rest on the base of the fireplace and are positioned to level the plurality of equally threaded horizontal pipes 44–54 to the floor of the fireplace. Each set of the plurality of bottom and top horizontal pipes 44–54 and 92–102, legs, connected by the plurality of vertical pipes 68–78, connecting members, form individual U-shaped structures. The air input manifold connects the plurality of horizontal pipes 44–54 together forming the U-shaped apparatus of the fireplace heat system 10. A fire is built on top of the plurality of equally threaded horizontal pipes 44–54 which act as the fireplace grate. The fireplace heating system 10 is capable of extracting well in excess of thirty thousand BTU/HR of heat from the fire which would otherwise be lost from a moderate fire in a standard fireplace up the chimney. The fireplace heat system 10 has a conservative overall heat transfer coefficient of at least nineteen. The heat transfer of this large magnitude is possible by forcing highly turbulent air through the fireplace heat system 10 resulting in maximized heat transfer.

In operation, the fireplace heat system 10 is installed in the fireplace 12 as illustrated in FIG. 1 of the drawing. High velocity turbulent air is directed from the forced air blower 14 such as a 140 CFM squirrel cage fan for way of example and purposes of illustration only into the air input manifold 42 from which the high velocity turbulent air is then distributed into the plurality of equally threaded horizontal lengths of pipe 44–54. As this turbulent air passes from the air input manifold 42 through the fire heated horizontal pipes 44–54 which also serve as the fireplace grate, the highly turbulent air extracts heat from the bottom horizontal pipes 44–54 as well as the vertical pipes 68–78 and the top horizontal pipes 92–102 which is subsequently delivered to the room environment as the air is exhausted from the ends of the top horizontal pipes 92–102. The overall structure of the fireplace heat system 10 produces turbulence.

Heat transfer in the fireplace heat system 10 is accomplished by the method of forced air convection. The forced air blower 14 delivers turbulent air into the air input manifold 42 of the fireplace heat system 10 resulting in a velocity of air into the air input manifold 42 of approximately twenty-five hundred feet per minute having a Reynold's number of nineteen thousand for the structure illustrated in the drawings. A Reynold's number in excess of ten thousand is considered to be fully turbulent. The heat transfer in excess of thirty thousand BTU/HR is a direct measure of the ability of the fireplace heat system 10 to extract heat from the plurality of hot pipes 44–54, 68–78 and 92–102 forming the connected U-shaped apparatus of the fireplace heat system 10.

The high value of heat transfer in the fireplace heat system is accounted for by a number of factors. First, is the effect of the highly turbulent forced air entering the series of short tubes from the air input manifold 42. Since relatively short tubes are used with a length to diameter ratio well below fifty, the entering effects of highly turbulent air entering the plurality of equally threaded horizontal pipes 44–54 from the air input manifold 42 contributes to additional turbulence of the boundary layer of air in contact with the inner walls of all the pipes as well as the junction of the air input manifold and the pipes. This results in additional heat transfer. Second, the heated air is forced around four right angles on its path to exhaust ports at the ends of the plurality of equally threaded horizontal lengths of pipe 92–102. This factor combined with the entrance effects discussed above operate to maintain the air in a turbulent state throughout its entire path of travel through the heated pipes of the fireplace heat system 10. Minor damping does occur as the air travels through the fire grate of the plurality of equally threaded horizontal lengths of pipes 44–54 and consequently the least turbulent air is found at the exhaust ports of the pipes 92–102 of the fireplace heat system 10. Third, the pipe utilized in the fireplace heat system 10 is one and one quarter inch black iron, 0.140 inch wall thick malleable pipe which is rough on the inside as well as the outside. While this particular type of pipe is used for way of example and purposes of illustration only, the particular type of pipe lends itself to having multiple rough edges on the interior diameter as well as the exterior diameter and further assists in transferring the heat from the fire on the grate formed by the pipes 44–50 to the air being passed through the U-shaped apparatus of the fireplace heat system 10. Fourth and last, to maximize heat transfer, a user is encouraged to partially embed the bottom horizontal pipes 44–54 of the grate in the fireplace heat system 10 in ashes and coals of the fire to obtain a higher heat transfer.

The fireplace heat system 10 allows for adjustment of the air flow throughout the pipes. This is desirable since the center pipes are in the hottest temperature of the fire zone with the temperature decreasing toward the outer edge of the fire zone. For this reason, it is advantageous to maximize the air flow in the center pipes and decrease it towards the outer pipes of the fireplace heat system. Pipe caps 104 and 108 with holes 106 and 110 respectively are screwed onto the ends of pipes 100 and 102 to balance air flow through the pipes of each U-shaped structure in the U-shaped apparatus of the fireplace heat system. The hole 110 for pipe cap 108 is one-half inch and the hole 106 for pipe cap 104 is five-eighths of an inch to achieve balanced air flow through the pipes. By utilizing pipe caps 104 and 106, the air flow is balanced for air exiting at the exhaust ports of the pipes to be 200–250 CFM for pipe 92, 400–450 CFM for tube 94, 500–550 CFM for pipe 96, 500–550 CFM for pipe 98, 400–450 CFM for pipe 100 and 200–250 CFM for pipe 102. These numerical values for outlet air velocities in cubic feet per minute (CFM) for each of the pipes at the exhaust ports are for way of example and purposes of illustration only for a 140 CFM squirrel cage forced air blower 14 and are not to be construed to be limiting to the invention. The resulting larger flow in air in the center pipes is immediately apparent as the symmetry of the flow of air with respect to the outer pipes in the fireplace heat system 10 being in the cooler section of the fire and thereby receiving the least air flow through the pipes.

The fireplace heat system 10 is uniquely constructed of individually threaded black pipe sections connected with elbows with each separate section being capable of individual replacement at minimum cost if such should ever be necessary. The heavy wall construction of the standard black iron malleable pipe with a thickness of 0.140 inch is approximately at least twice as thick as the thin wall tubing of the prior art units. The pipe of this construction can withstand many years of exposure to extremely high temperatures of fires without failure of burn through. The construction of the fireplace heat system 10 also readily permits the system to conform to any existing or proposed fireplace.

Various modifications can be made to the fireplace heat system of the present invention without departing from the apparent scope of this invention.

The forced air blower 14 may be incorporated into any existing fireplace wall structure opposed to placing the blower adjacent to the fireplace. The hose 16 may be flexible metal exhaust pipe or a suitable plastic hose as the air being forced into the street elbow 18 and down the manifold composed of the alternating tees 20–30 and closed nipples 32–40 provide coolness at the street elbow 18 so as not to melt plastic tubing. The elbows may be other than ninety degrees as required to physically adapt the system to a fireplace 12. The nipples may be other than close nipples. The lengths of pipe are not critical as long as damping does not occur and the length to diameter ratio is less than fifty. Any number of connected U-shaped structures may be utilized and is not limited to six as is illustrated for way of example and purposes of illustration only. Also, any number of air restricting and balancing pipe caps may be utilized to achieve a balanced effect or desired effect in the system. Finally, the system may be utilized as other prior art systems without a forced air blower.

Having thus described the invention, there is claimed as new and desired to be secured by Letters Patent:

1. Fireplace heat system for extracting heat from a fire in a fireplace comprising:

a. plurality of U-shaped structure means, each of said U-shaped structure means including two opposing substantially parallel horizontal legs of thick wall malleable black iron pipe and including threads on each end of each of said legs, plurality of substantially vertical connecting members of said black pipe and including threads on each end, and two pluralities of pipe elbows of said black pipe, each of said pipe elbows threaded onto each threaded end of said connecting member and one threaded end of each of said opposing legs;

b. air input manifold means connecting bottom legs of each of said plurality of U-shaped structure means together, said air input manifold means including plurality of alternating tees and nipples of said black pipe screwed together, said plurality of tees being one greater than said plurality of nipples, a plug of said black pipe screwed into the furthest end of said last tee, and said bottom legs of each of said plurality of U-shaped structure means connected to the bottom leg of each of said tees;

c. forced air input means connected to closet end of said first tee of said air input manifold means including a street elbow of said black pipe connected to the closest end of said first tee of said air input manifold means, one end of a hose connected to said street elbow with a hose clamp, and the other end of said hose connected to a blower with a hose clamp, said blower exhausting high velocity turbulent air into said pipes at a high velocity into said air input manifold means, said;

d. plurality of pipe caps of said black pipe including circular holes in said respective pipe caps and screwed onto said furthest threaded ends of top legs of said plurality of U-shaped structure means from said forced air means whereby said pipe caps restrict and balance the air flow over said U-shaped structure means, and turbulence is produced to maximize heat transfer from the fire in the fireplace to the environment adjacent the fireplace by the rough interior diameter as well as the exterior diameter of said thick wall malleable black iron pipe, by the boundary layers of air between said U-shaped structure means and said air input manifold means, by the air entering the bottom pipes of said plurality of U-shaped structure means, and by the forcing of the high velocity air around the plurality of angles of said pipes at said tees and elbows from said air input manifold means to said plurality of U-shaped structure means to further create turbulence thereby resulting in maximized heat transfer from the fire in the fireplace to the environment adjacent the fireplace where each of said black pipe is replaceable.

2. The fireplace heat system of claim 1 wherein said thick wall malleable black iron pipe is one and one-quarter inch black iron 0.140 inch thick wall malleable black iron pipe.

3. The fireplace heat system of claim 1 wherein said legs are of a length to diameter ratio of less than 50.

4. The fireplace heat system of claim 1 wherein said blower is a 140 CFM squirrel cage blower.

5. The fireplace heat system of claim 1 wherein said air flow in said system is turbulent.

6. The fireplace heat system of claim 1 wherein said heat transfer coefficient is substantially 19.

7. The fireplace heat system of claim 1 wherein said heat transfer is substantially thrity thousand BTU/HR.

8. Fireplace heat system for extracting heat from a fire in a fireplace comprising:

a. plurality of six U-shaped structure means, each of said U-shaped structure means including two opposing substantially parallel horizontal legs of one and one-quarter inch black iron 0.140 inch thick wall malleable pipe and including threads on each end of each of said legs, said legs being of a short length and having a length to diameter ratio of substantially twenty, plurality of substantially vertical connecting members of said black pipe and including threads on each end, and two pluralities of right angle pipe elbows of said black pipe, each of said pipe elbows threaded onto each threaded end of said connecting member and one threaded end of each of said opposing legs;

b. air input manifold means connecting bottom legs of each of said plurality of U-shaped structure means together, said air input manifold means including plurality of alternating ninety degree tees and close nipples of said black pipe screwed together, said plurality of tees being one greater than said plurality of nipples, a plug of said black pipe screwed into furthest end of said last tee, and bottom legs of each of said plurality of U-shaped structure means connected to bottom leg of each of said tees;

c. forced air input means connected to closest end of said first tee of said air input manifold means including a right angle street elbow of said black pipe connected to the closest end of said first tee of said air input manifold means, one end of a hose connected to said street elbow with a hose clamp, and the other end of said hose connected to a squirrel cage blower with a hose clamp, said blower exhausting high velocity turbulent air at a high velocity into said air input manifold means, and;

d. plurality of pipe caps of said black pipe including circular holes of a larger hole and a small hole in said respective pipe caps and screwed onto said furthest and said next to said furthest threaded ends respectively of top legs of said plurality of U-shaped structure means from said forced air means whereby said pipe caps restrict and balance the air flow over said U-shaped structure means, and turbulence is produced to maximize the heat transfer coefficient of a Reynolds number being at least nineteen from the fire in the fireplace to the environment adjacent the fireplace by the rough interior diameter as well as exterior diameter of said black pipe, by the boundary layers of air between said U-shaped structure means and said air input manifold means, by the air entering the bottom pipes of said plurality of U-shaped structure means, and by forcing of the air around the plurality of right angles of said pipes at said tees and elbows from said air input manifold means to said plurality of U-shaped structure means to further create turbulence thereby resulting in maximized heat transfer from the fire in the fireplace to the environment adjacent the fireplace where each of said black pipes is replaceable.

* * * * *